US010138763B2

(12) United States Patent
Miyazawa

(10) Patent No.: US 10,138,763 B2
(45) Date of Patent: Nov. 27, 2018

(54) ROCKER ARM

(71) Applicant: OTICS CORPORATION, Aichi (JP)

(72) Inventor: Daiki Miyazawa, Nishio (JP)

(73) Assignee: OTICS CORPORATION, Aichi (JP)

( * ) Notice: Subject to any disclaimer, the term of this patent is extended or adjusted under 35 U.S.C. 154(b) by 50 days.

(21) Appl. No.: 15/435,601

(22) Filed: Feb. 17, 2017

(65) Prior Publication Data

US 2017/0292414 A1 Oct. 12, 2017

(30) Foreign Application Priority Data

Apr. 8, 2016 (JP) ..... 2016-078042

(51) Int. Cl.
*F01L 1/18* (2006.01)
*F01L 1/047* (2006.01)

(52) U.S. Cl.
CPC ..... *F01L 1/181* (2013.01); *F01L 1/047* (2013.01); *F01L 1/18* (2013.01); *F01L 1/182* (2013.01); *F01L 2105/00* (2013.01); *F01L 2105/02* (2013.01); *Y10T 74/20882* (2015.01); *Y10T 74/2107* (2015.01)

(58) Field of Classification Search
CPC ... F01L 1/181; F01L 1/182; F01L 1/18; F01L 1/047; F01L 2105/02; F01L 2105/00; Y10T 74/20882; Y10T 74/2107
See application file for complete search history.

(56) References Cited

U.S. PATENT DOCUMENTS

2006/0126985 A1* 6/2006 Ochi ..... F01L 1/18 384/625

FOREIGN PATENT DOCUMENTS

JP H04-75109 * 6/1992 ..... F01L 1/18
JP 2008-075482 4/2008

* cited by examiner

*Primary Examiner* — Mark A Laurenzi
*Assistant Examiner* — Wesley G Harris
(74) *Attorney, Agent, or Firm* — Wenderoth, Lind & Ponack, L.L.P.

(57) ABSTRACT

A rocker arm includes a roller, a support shaft coaxially mounted in the roller, walls arranged along a rotation axis and having the roller therebetween and having through holes, respectively, through which end portions of the support shaft are inserted, and each of the walls having an inner surface opposite the roller, and holding members mounted in the respective walls. The holding member includes a tubular portion mounted in each through hole and disposed between an inner peripheral surface of the through hole and an outer surface of an end portion of the support shaft, a first stopper portion included at a first end of the tubular portion to be in contact with the inner surface of one of the walls, and a second stopper portion included at a second end of the tubular portion to be in contact with an end surface of one of the end portions.

9 Claims, 5 Drawing Sheets

ROCKER ARM

CROSS REFERENCE TO RELATED APPLICATION

This application claims priority from Japanese Patent Application No. 2016-78042 filed on Apr. 8, 2016. The entire contents of the priority application are incorporated herein by reference.

FIELD OF THE INVENTION

The present disclosure relates to a rocker arm.

BACKGROUND OF THE INVENTION

A rocker arm that transmits pressure force from a cam to a valve in a vehicular engine has been known. The rocker arm includes a roller that is in contact with the cam. The roller is rotatably supported by a support shaft. The support shaft is mounted on a pair of walls that sandwich the roller therebetween and the support shaft and the walls are fastened together with a fixing member.

SUMMARY OF THE INVENTION

The support shaft receives a load of a pressing force from the cam. With the above fastening configuration of the support shaft and the walls, the support shaft always receives the load from the cam at the same portion that faces the cam and the portion is likely to be worn compared to other portions.

The present technology has been made in view of the aforementioned circumstances. An objective of the present technology is to provide a rocker arm including a long lasting support shaft.

To solve the above problem, according to the present technology, a rocker arm includes a roller to be contacted with a cam and having a rotation axis, a support shaft extending along the rotation axis and coaxially mounted in the roller to rotatably support the roller to rotate about the rotation axis, the support shaft having end portions, walls extending perpendicular to the rotation axis and opposite each other with the roller located therebetween, the walls each having a through hole through which a respective one of the end portions of the support shaft is inserted, and each of the walls having an inner surface opposite the roller, a bearing arranged between the support shaft and the roller, and holding members each mounted to a respective one of the walls for holding the support shaft. Each of the holding members includes a tubular portion arranged in one of the through holes of one of the walls and disposed between an inner peripheral surface of the one of the through holes and an outer surface of one of the end portions of the support shaft, the tubular portion having a first end and a second end, the first end being opposite the roller, a first stopper portion included at the first end of the tubular portion adjacent to the inner surface of the one of the walls, and a second stopper portion included at the second end of the tubular portion adjacent to an end surface of the one of the end portions of the support shaft.

DETAILED DESCRIPTION OF THE PREFERRED EMBODIMENTS

Figure 1:
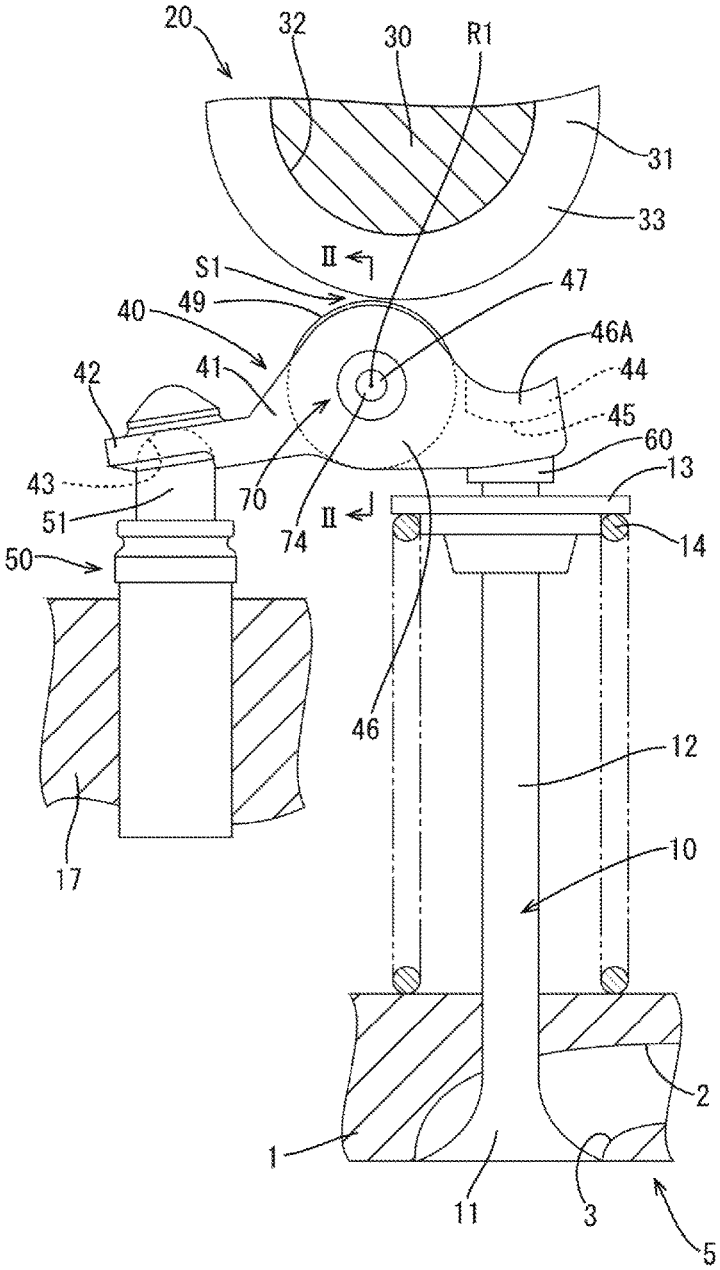
FIG. 1 is a cross-sectional view illustrating a vehicular engine according to a first embodiment of the present technology.

One embodiment of the present technology will be described with reference to FIGS. 1 to 5. As illustrated in FIG. 1, a vehicular engine 5 of this embodiment includes a cylinder head 1, a cam housing 17 mounted on an upper side with respect to the cylinder head 1, and a valve drive device 20. The cylinder head 1 includes an intake valve 10 that opens and closes an intake port 3 and a discharge valve (not illustrated) that opens and closes a discharge port. Hereinafter, the intake valve 10 and the valve drive device 20 that is on an intake side and opens and closes the intake valve 10 will be described in detail. The discharge valve and a valve drive device on a discharge side have configurations similar to those of the intake side.

The intake valve 10 includes a valve stem 12 having a bar shape and a valve member 11 having a disk-like shape. The valve member 11 is at a lower end of the valve stem 12. The valve member 11 is arranged in an intake passage 2 included in the cylinder head 1. The intake passage 2 communicates with an inner space of a cylinder (not illustrated). The valve member 11 opens and closes an intake port 3 that communicates with the cylinder and the intake passage 2. The valve stem 12 passes through an outer wall of the intake passage 2 and an upper end portion of the valve stem 12 projects outside (on an upper side in FIG. 1) the intake passage 2.

A spring retainer 13 having a disk-like shape is mounted on the upper end portion of the valve stem 12. A valve spring 14 is mounted between an outer surface (an upper surface) of the cylinder head 1 and the spring retainer 13. The valve spring 14 is compressed from a normal state (having a normal length). The intake valve 10 is urged toward the rocker arm 40 (upward in FIG. 1) by an elastic force of the valve spring 14 and the valve member 11 is urged to close the intake port 3.

The valve drive device 20 opens and closes the intake valve 10. The valve drive device 20 includes a cam 31, a camshaft 30 inserted in the cam 31, a rocker arm 40, and a pivot 50. The rocker arm 40 is pivoted according to rotation of the cam 31 and converts the rotation movement of the cam 31 to up-down movement. The rocker arm 40 transfers the converted up-down movement to the intake valve 10. The pivot 50 has a pivot support point of the rocker arm 40 and is mounted on the cam housing 17. A lash adjuster may be used instead of the pivot 50.

The camshaft 30 is a hollow round bar and is arranged away from the distal end of the valve stem 12 and perpendicular to the valve stem 12. The camshaft 30 is rotatably supported between the cam housing 17 and a cam cap (not illustrated). The cam 31 is fixed to the camshaft 30. The cam 31 has a plate-like shape and an egg shape from a front view and has a shaft hole 32 where the camshaft 30 is inserted. The shaft hole 32 is a through hole that extends through the cam 31 from one plate surface to another plate surface. The cam 31 is fixed to the camshaft 30 and rotatable together with the camshaft 30. The cam 31 includes a base portion 33 and a cam nose portion (not illustrated). The cam 31 has a constant distance from a rotation center (a center of the shaft hole 32) to an outer peripheral edge at the base portion 33.

The cam 31 has a distance from the rotation center (the center of the shaft hole 32) to the outer peripheral edge at the cam nose portion 33 that is greater than that of the base portion 33.

The rocker arm 40 has an elongated shape extending in a direction perpendicular to the rotation axis of the cam 31 (in a right-left direction in FIG. 1) and perpendicular to an elongated direction of the valve stem 12. The rocker arm 40 is arranged between the cam 31 and the valve stem 12. The rocker arm 40 includes a roller 49 that is in contact with the cam 31 and an arm main body 41 that rotatably holds the roller 49. The arm main body 41 has a pivot support portion 42 at one end portion thereof so as to be supported by the pivot 50 such that the arm main body 41 is able to be pivoted. The arm main body 41 has a valve contact portion 44 (a dotted line in FIG. 1) at another end portion thereof. The valve contact portion 44 is in contact with the intake valve 10 via a shim 60.

The shim 60 is a spacer between the valve stem 12 and the valve contact portion 44. A preferable one is selected for the shim 60 among shims having various thicknesses. A clearance S1 between the cam 31 and the roller 49 is adjusted by adjusting the thickness of the shim 60. The shim 60 mounted on the valve stem 12 according to the present embodiment may be called a stem cap or a stem end cap.

The pivot support portion 42 has a shape following a distal end portion 51 of the pivot 50 and has a spherical recessed portion 43 (illustrated by a broken line in FIG. 1) on a lower surface thereof. The spherical recessed portion 43 receives the distal end portion 51 of the pivot 50. As illustrated by a broken line in FIG. 1, the valve contact portion 44 has a valve receiving surface 45 on a lower surface thereof and the valve receiving surface 45 is in contact with the shim 60 and is a curved surface projecting toward the shim 60.

In the present embodiment, when the base portion 33 of the cam 31 is opposite the roller 49 (in a base state), the intake valve 10 is urged upward by the valve spring 14 with urging force of the valve spring 14 and in a closed state. Namely, the valve member 11 closes the intake port 3. When the cam nose portion of the cam 31 is in contact with the roller 49 (in a lift state), the cam 31 presses the rocker arm 40 downward. Accordingly, the intake valve 10 is pressed down by the valve contact portion 44 and is in an open state.

Figure 2:
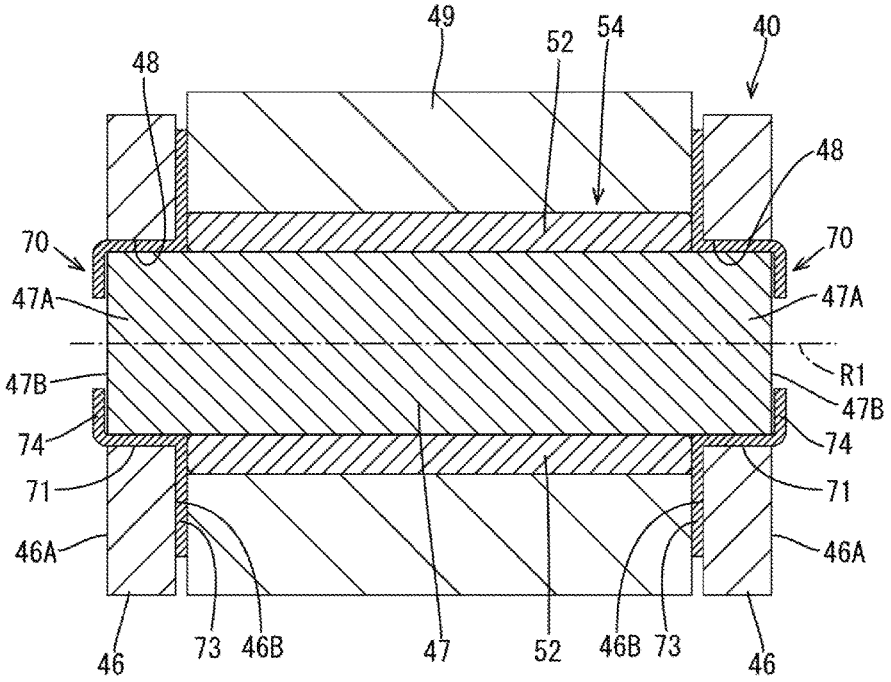
FIG. 2 is a cross-sectional view of a rocker arm in FIG. 1 taken along line II-II in FIG. 1.

As illustrated in FIG. 2, the arm main body 41 includes a pair of walls 46. The walls 46 are opposite each other with having the roller 49 therebetween. The walls 46 are arranged in an axial direction of a rotation axis R1 of the roller 49 (in a right-left direction in FIG. 2). A support shaft 47 is mounted in the walls 46 via a pair of holding members 70. The support shaft 47 rotatably supports the roller 49 and is a shaft member that sets the rotation axis R1 of the roller 49. The support shaft 47 has a solid columnar member extending along the rotation axis R1.

As illustrated in FIG. 2, the roller 49 has a cylindrical shape and a bearing 54 is arranged between the roller 49 and the support shaft 47. The bearing 54 is a roller bearing and includes columnar rolling members 52 (rollers) that are arranged around the rotation axis R1 in a ring shape. According to such a configuration, the roller 49 is rotatable with respect to the support shaft 47 around the rotation axis R1. An upper surface of the roller 49 is above upper surfaces of the walls 46. In other words, an outer peripheral surface of the roller 49 extends beyond distal end surfaces of the respective walls with respect to the rotation axis R1. According to such a configuration, the roller 49 can contact the outer peripheral surface of the cam 31 where the roller 49 extends upward beyond the upper surfaces of the walls 46.

Figure 5:
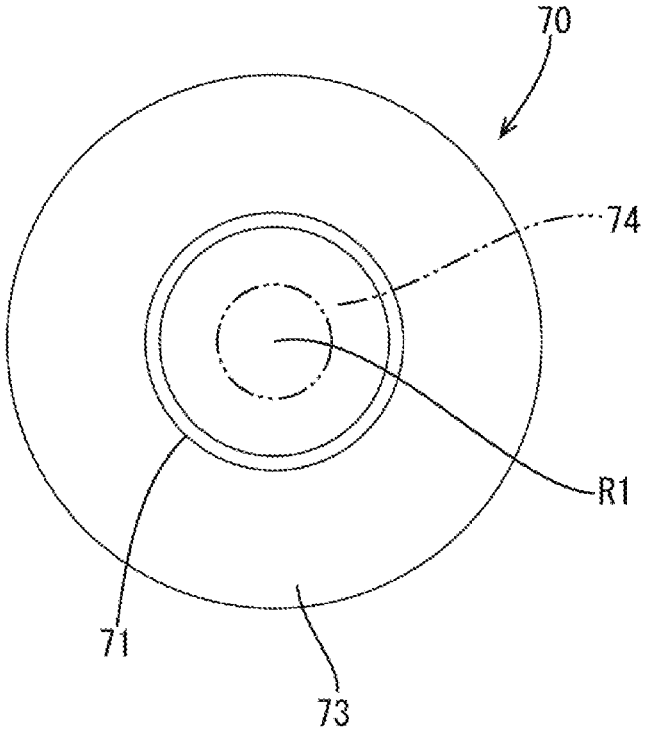
FIG. 5 is a front view of the holding member.

The holding member 70 is mounted to each of the walls 46. The support shaft 47 is held in the walls 46 via the holding members 70, respectively. As illustrated in FIG. 5, the holding member 70 has a circular shape with a front view as a whole and includes a tubular portion 71 having a cylindrical shape, a first stopper portion 73, and a second stopper portion 74. The tubular portion 71 has a first end that faces the roller 49 and a second end that is opposite from the first end. The first stopper portion 73 is included at the first end and the second stopper portion 74 is included at the second end. The first stopper portion 73 extends outwardly from the first end and away from the rotation axis R1, and the second stopper portion 74 extends inwardly from the second end toward the rotation axis R1.

As illustrated in FIG. 2, the tubular portion 71 is inserted in a circular through hole 48 formed in each wall 46. An end portion 47A of the support shaft 47 is inserted in a space within the tubular portion 71. Each end portion 47A in the tubular portion 71 is inserted in the through hole 48, and the tubular portion 71 is disposed between an inner surface of the through hole 48 of the wall 46 and an outer peripheral surface of the end portion 47A. Namely, each of two end portions 47A of the support shaft 47 is inserted in one of the through holes 48 formed in the respective walls 46. An inner surface of the tubular portion 71 is in contact with the outer peripheral surface of the end portion 47A and an outer surface of the tubular portion 71 is in contact with the inner surface of the through hole 48.

As illustrated in FIG. 5, the first stopper portion 73 extends from the first end of the tubular portion 71 over an entire periphery of the tubular portion 71. The wall 46 has an outer surface 46A and an inner surface 46B that faces an end surface of the roller 49 and is covered by the first stopper portion 73. The first stopper portion 73 is stopped by the inner surface 46B of the wall 46. As illustrated in FIG. 2, the first stopper portion 73 has a ring shape following a shape of the end surface of the roller 49 and is disposed between the wall 46 and the roller 49 (and the bearing 54).

Figure 3:
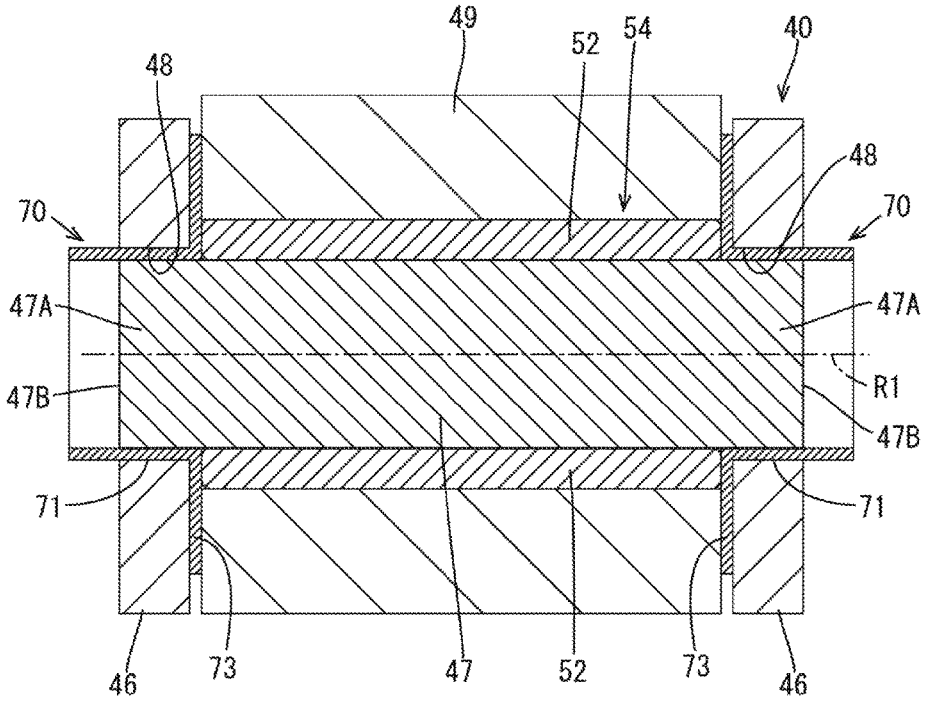
FIG. 3 is a cross-sectional view of the rocker arm where a holding member is mounted.
Figure 4:
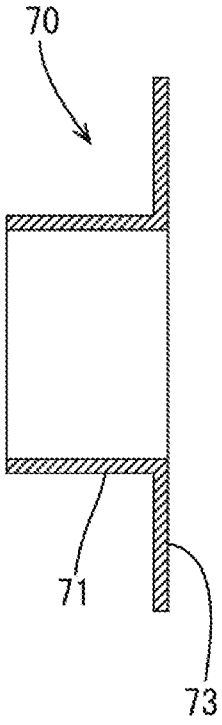
FIG. 4 is a cross-sectional view of the holding member.

The second stopper portion 74 is disposed to overlap the end surface 47B of the support shaft 47 and covers a peripheral end portion of the end surface 47B. As illustrated in FIG. 4, the holding member 70 before being mounted on the wall 46 has no second stopper portion 74. As illustrated in FIG. 3, the holding member 70 is mounted to the wall 46 such that the tubular portion 71 is inserted into the through hole 48 of the wall 46. Then, a portion of the tubular portion 71 projecting outside the through hole 48 (an end portion of the tubular portion 71) is bent inwardly at an opening edge of the through hole 48 over an entire periphery thereof (or partially). Thus, the second stopper portion 74 is formed. The second stopper portion 74 covers a peripheral edge portion of the end surface 47B of the support shaft 47 and does not cover a middle portion thereof including a rotation center. Therefore, in the configuration that the support shaft 47 is rotatable with respect to the holding members 70, friction is less likely to be caused by the rotation of the support shaft 47.

The support shaft 47 is held by the second stopper portions 74 of the respective holding members 70 and sandwiched by the second stopper portions 74 in the axial direction. Accordingly, the movement of the support shaft 47 with respect to a direction of the rotation axis R1 (in a right-left direction in FIG. 2) is restricted and the support shaft 47 is not dropped from the walls 46. In the present embodiment, the holding members 70 and the support shaft 47 are rotatable around the rotation axis R1. The support shaft 47 and the holding members 70 are independently rotatable. However, the support shaft 47 and the holding members 70 may be rotated together as an integral member. The holding members 70 may be fixed to the respective walls 46 not to be rotatable with respect to the walls 46 and the support shaft 47 may be rotatable with respect to the holding members 70.

The first stopper portions 73 may be in contact with the respective walls 46 and the roller 49 (or the bearing 54) or may be spaced from the respective walls 46 and the roller 49 (the bearing 54). The second stopper portions 74 may be in contact with the respective end surfaces 47B of the support shaft 47 or may be spaced therefrom. Each of the holding members 70 has a surface having friction coefficient smaller than that of the support shaft 47 and the walls 46. Accordingly, the friction is less likely to be caused by the rotation of the roller 49 compared to a configuration where the roller 49 and the support shaft 47 are directly in contact with the walls 46. Examples of methods of reducing the friction coefficient of the surface of the holding member 70 are described below. The holding members 70 may be made of material having a friction coefficient smaller than that of the walls 46 and the support shaft 47. The holding members 70 may be subjected to a surface treatment such as diamond-like carbon coating. The holding members 70, the support shaft 47, and the walls 46 may not necessarily have a friction coefficient of the above-described relation. For example, the holding members 70 may have a friction coefficient smaller than that of one of the support shaft 47 and the walls 46.

Advantageous effects of the present embodiment will be described below. In the present embodiment, each of the holding members 70 includes the first stopper portion 73 that is stopped by the inner surface 46B of one wall 46 facing the roller 49, and the first stopper portion 73 is connected to the second stopper portion 74 via the tubular portion 71. The second stopper portion 74 is stopped by the end surface 47B of the support shaft 47. Accordingly, the support shaft 47 is positioned with respect to an axial direction thereof by a pair of second stopper portions 74 included in the respective holding members 70. Thus, the support shaft 47 is fixed to the walls 46 without fastening and is rotatable with respect to the walls 46.

When the rocker arm 40 is moved, the support shaft 47 receives pressing force from the cam 31 and receives a load (radial load) on a surface thereof opposite the cam 31. If the support shaft is fixed to the walls so as not to be rotatable, the support shaft always receives a load on a same portion (a surface opposite the cam) and abrasion is likely to be caused on the portion receiving the load. In the above configuration where the support shaft 47 is rotatable, when the rocker arm 40 is moved, the support shaft 47 is rotated according to rotation of the roller 49. Therefore, the support shaft 47 receives the load from the cam 31 on a different portion in a circumferential direction of the support shaft 47 over an entire periphery. Accordingly, abrasion is less likely to be caused in only a certain portion of the support shaft 47 and the support shaft 47 has a long life.

With the configuration where the support shaft is fastened to the walls, the cylindrical support shaft has a fastening portion at an outer peripheral portion and a large fastening portion is required to ensure effective fastening strength. Thus, an outer diameter of the support shaft is likely to be increased. In the present embodiment, the support shaft 47 is held in the walls 46 with the holding members 70. According to such a configuration, in the present embodiment without having a fastening configuration, the support shaft does not need to include a fastening portion and fastening strength does not need to be ensured. The support shaft 47 does not need to have a greater diameter to ensure the holding strength. Therefore, the support shaft 47 has a smaller outer diameter compared to that in the configuration with the fastening configuration.

The holding members 70 are mounted in the respective walls 46 to be rotatable around the rotation axis R1 of the roller 49. The first stopper portion 73 is between the roller 49 and each wall 46. With such a configuration, the roller 49 and the walls 46 are not directly in contact with each other due to the respective first stopper portions 73. The holding members 70 are rotatable around the rotation axis of the support shaft 47. Therefore, the first stopper portions 73 are rotated according to the rotation of the roller 49. Thus, the abrasion of the roller 49 is less likely to be caused.

In the present embodiment, the first stopper portion 73 is connected to the second stopper portion 74 via the tubular portion 71. The tubular portion 71 is disposed between the inner hole surface of the through hole 48 and an outer peripheral surface of the support shaft 47. Accordingly, the support shaft 47 and the walls 46 are less likely to contact each other and the support shaft 47 is rotated smoothly.

OTHER EMBODIMENTS

The present technology is not limited to the above embodiments explained in the above description and the drawings. The technology described herein includes various modifications as described below.

(1) In the above embodiments, the roller bearing is described as the bearing 54. However, a ball bearing may be used as the bearing 54.

(2) In the above embodiments, the rocker arm 40 included in the intake-side valve drive device 20 is described. However, the rocker arm 40 may be used in a discharge-side valve drive device.

(3) In the second embodiment, the support shaft 47 is solid but may have a hollow shape (a cylindrical tubular shape).

The invention claimed is:

1. A rocker arm comprising:

a roller to be contacted with a cam and having a rotation axis;

a support shaft extending along the rotation axis and coaxially mounted in the roller to rotatably support the roller to rotate about the rotation axis, the support shaft having end portions;

walls extending perpendicular to the rotation axis and opposite each other with the roller located therebetween, the walls each having a through hole through which a respective one of the end portions of the support shaft is inserted, and each of the walls having an inner surface opposite the roller;

a bearing arranged between the support shaft and the roller; and holding members each mounted to a respective one of the walls for holding the support shaft, each of the holding members including:

a tubular portion arranged in one of the through holes of one of the walls and disposed between an inner peripheral surface of the one of the through holes and an outer surface of one of the end portions of the support shaft, the tubular portion having a first end and a second end, the first end being opposite the roller;

a first stopper portion included at the first end of the tubular portion adjacent to the inner surface of the one of the walls, and a second stopper portion included at the second end of the tubular portion adjacent to an end surface of the one of the end portions of the support shaft, wherein the holding members and the support shaft are coaxially arranged and the holding members are rotatable around the rotation axis with respect to the walls, and the first stopper portion of each of the holding members is disposed between the roller and one of the walls.

2. The rocker arm according to claim 1, wherein, for each of the holding members, the first stopper portion extends from the first end outward with respect to the tubular portion, and the second stopper portion extends from the second end inward with respect to the tubular portion.

3. The rocker arm according to claim 1, wherein each of the second stopper portions overlaps the end surface of one of the end portions of the support shaft.

4. The rocker arm according to claim 3, wherein, for each of the holding members, the second stopper portion overlaps a peripheral edge portion of one of the end surfaces of the support shaft, and the one of the end surfaces of the support shaft has a middle portion including a rotation center and the middle portion is uncovered with the second stopper portion.

5. The rocker arm according to claim 1, wherein, for each of the holding members, the first stopper portion is in contact with one of the walls and the roller, and the second stopper portion is in contact with one of the end surfaces of the support shaft.

6. The rocker arm according to claim 1, wherein each of the tubular portions has a space therein and receives one of the end portions of the support shaft in the space.

7. The rocker arm according to claim 1, wherein, for each of the holding members, the first stopper portion is between the inner surface of one of the walls and the roller, and the inner surface of the one of the walls and the inner peripheral surface of the through hole of the one of the walls are not in contact with the roller and one of the end portions of the support shaft inserted into the through hole of the one of the walls.

8. The rocker arm according to claim 1, wherein the holding members have a friction coefficient smaller than that of the walls and the roller.

9. The rocker arm according to claim 1, wherein the second stopper portion of each of the holding members holds the support shaft therebetween with respect to an axial direction of the support shaft.

* * * * *